United States Patent [19]

Asick et al.

[11] 4,130,332

[45] Dec. 19, 1978

[54] MODULAR CONNECTOR AND CRIMP ARRANGEMENT FOR MAGNETIC WIRE

[75] Inventors: John C. Asick, Harrisburg; Clifton W. Huffnagle, Camp Hill; Michael S. Peppler, Lancaster; John A. Woratyla, Camp Hill, all of Pa.

[73] Assignee: AMP Incorporated, Harrisburg, Pa.

[21] Appl. No.: 889,756

[22] Filed: Mar. 24, 1978

[51] Int. Cl.[2] ..... H01R 13/38

[52] U.S. Cl. ..... 339/97 P

[58] Field of Search ..... 339/97 R, 97 P, 98, 339/99 R

[56] References Cited

U.S. PATENT DOCUMENTS

| | | | |
|---|---|---|---|
| 3,958,853 | 5/1976 | Wilson | 339/99 R |
| 4,074,929 | 2/1978 | Krider | 339/97 R |
| 4,083,615 | 4/1978 | Volinskie | 339/99 R |

*Primary Examiner*—Joseph H. McGlynn
*Attorney, Agent, or Firm*—Russell J. Egan

[57] ABSTRACT

A modular connector and scheme for crimping magnetic wire thereto are disclosed. The subject connector is particularly useful for interconnecting wires of magnetic coils, found in dot matrix print heads, directly to standard flat flexible cable, ribbon cable, or round wire conductors on closely centered grids. The connector allows for each coil to be individually repairable separate from all other coils and eliminates the previous assembly steps of splicing and soldering the wires of the coils onto a printed circuit board header which in turn was connected to a cable.

5 Claims, 4 Drawing Figures

MODULAR CONNECTOR AND CRIMP ARRANGEMENT FOR MAGNETIC WIRE

BACKGROUND OF THE INVENTION

1. The Field of the Invention

The present invention relates to a modular connector and in particular to a modular connector which individually crimp connects terminals onto wires of a plurality of coils in a dot matrix print head in such a manner as to allow their direct interconnection with standard flat flexible cable, ribbon cable, or round wire conductors on closely centered grids.

2. The Prior Art

The previous method of connecting the wires of the multiple coils of a dot matrix print head to an interface involved splicing or soldering the stripped magnetic wire to an interface printed circuit board. The printed circuit board then had to be provided with further connector means to interface with the standard wiring of the printer, which wiring could be flat cable, ribbon cable, or discrete wires on close center lines.

SUMMARY OF THE INVENTION

The present invention has a two part housing comprising a base and a cover defining a closed cavity therebetween. The base is provided with a plurality of channels which together define a comb-like configuration into which the individual wires of the coils of a dot matrix print head are laced. A plurality of contact modules, each including a contact terminal and an insulative block integrally molded thereon, are provided to mate in each said channel. Each contact terminal has an insulation displacing, wire engaging portion extending from a first surface of the block and a mating portion extending from a second surface. The mating of the contact module in each channel causes an electrical and mechanical engagement between the terminal and the conductor laced therein. The modules are secured in the base of the housing by interference fit between the module and housing and by attachment of the cover to the base.

It is therefore an object of the present invention to produce an improved modular connector which allows the interconnection of the wires of a plurality of magnetic coils in a dot matrix print head directly to a header allowing interconnection with standard flat flexible cable, ribbon cable, or round wire conductors on a closely centered arrangement.

It is a further object of the present invention to produce a method and apparatus for interconnecting wire leads of a plurality of magnetic coils in a dot matrix print head in such a manner that the previously required steps of splicing and soldering to an interface printed circuit board are eliminated.

It is a further object of the present invention to produce an improved modular connector for interconnecting wire leads of a plurality of magnetic coils in a dot matrix print head which allows separate repair of individual coils without disturbing the interconnection of the remaining coils.

It is a further object of the present invention to produce an improved modular connector for interconnecting wire leads of a plurality of magnetic coils in a dot matrix print head to conventional cables, which connector can be readily and economically manufactured.

The means for accomplishing the foregoing objects and other advantages of the present invention will be come apparent to those skilled in the art from the following detailed description taken with reference to the accompanying drawings.

DETAILED DESCRIPTION OF THE PREFERRED EMBODIMENT

Figure 4:
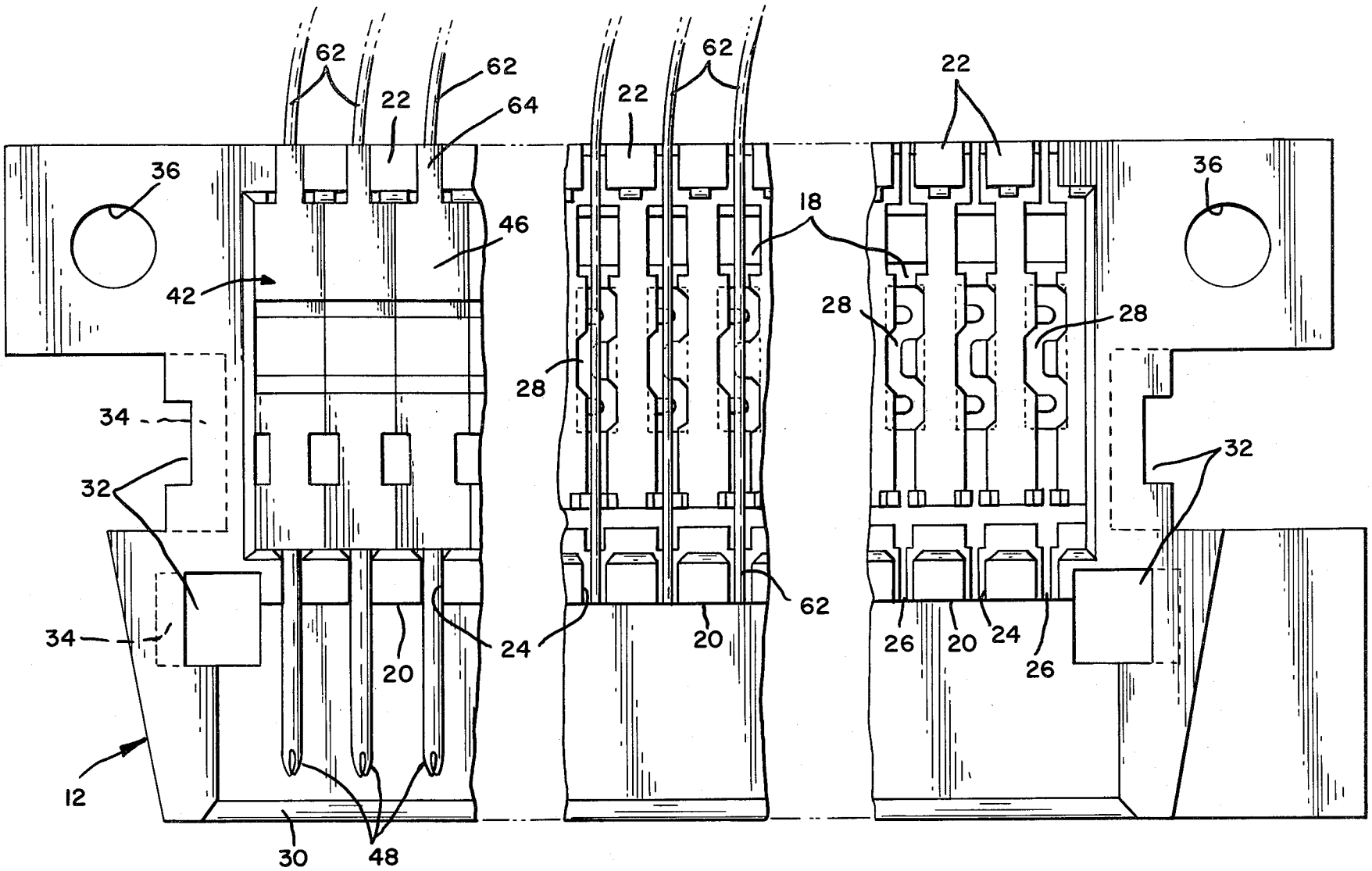
FIG. 4 is a top plan view of the housing base member of the subject connector.

The subject modular connector 10 has a two part housing including base member 12 and a mating cover 14, which together define a closed cavity 16. The base member 12 includes a plurality of parallel, spaced transverse channels 18 extending through cavity 16 forming profiled comb-like configurations in the front and rear walls 20, 22, respectively. Each comb-like configuration is defined by a plurality of parallel spaced slots each having a wide entry 24 and a contiguous narrow terminus 26. Each channel 18 also includes a contact receiving recess 28 intermediate the front and rear walls and having a generally W-shaped profile as best seen in FIG. 4. The base member 12 also includes a contact enclosing shroud 30, cover latching passages 32, each of which includes a latching shoulder 34, and mounting apertures 36. The cover 14 has substantially the same overall configuration as the base member 12 and includes a plurality of latching members 38 depending therefrom aligned with the respective passages 32 in the base member 12. Each latching member 38 has a lip 40 on the free end thereof adapted to engage a respective shoulder 34. A plurality of contact modules 42 are provided with each connector module including a terminal 44 molded into an insulated block 46. The terminal 44 includes a first mating portion 48 having a profile adapted to mate with a further terminal (not shown) and an insulation displacing conductor engaging second portion 50 comprising a plurality of tines 52, 54, 56 defining therebetween conductor engaging slots 58, 60. The tines have oppositely directed concave transverse sections which conform to the shape of the slot 28 in the base member. The tines together define a tortuous path for a conductor 62. The inwardly directed edges of each tine make engagement with the respective conductors 62 with an interference fit which assures penetration of insulation on the conductors to achieve a good electrical and mechanical engagement. The contact modules 42 also include a rearwardly directed mounting stud 64 and a downwardly directed conductor engaging stud 66. The contact modules 42 are preferably molded in strip form with a flexible strip 68 holding the modules together for insertion, either individually or in gang fashion by hand or by machine, into the connector.

Figure 1:
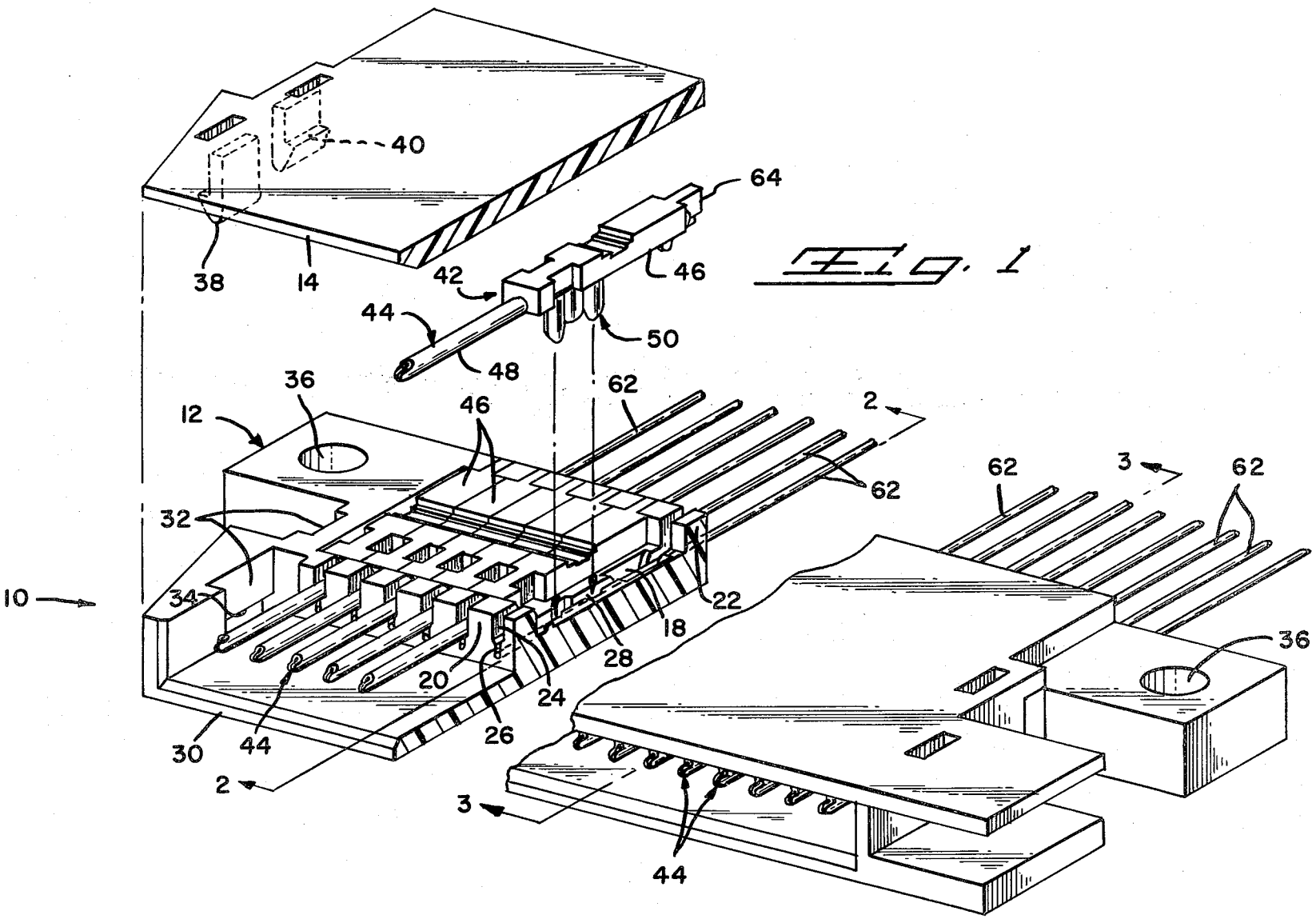
FIG. 1 is a perspective view of both end fragments of a connector according to the present invention with the left hand end in an exploded condition and the right hand end in an assembled condition.
Figure 2:
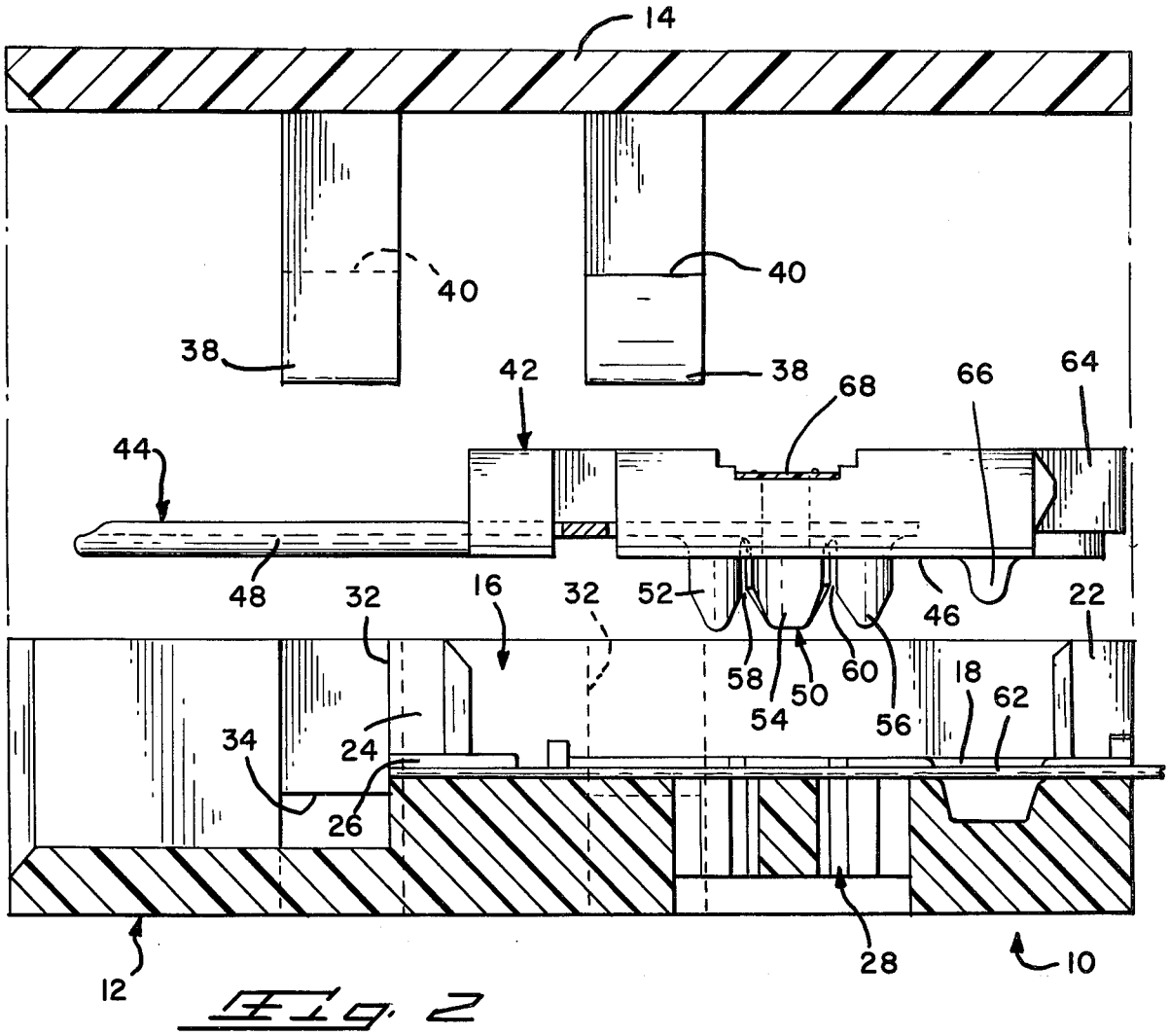
FIG. 2 is a transverse, vertical section through the subject connector taken along line 2—2 of FIG. 1.
Figure 3:
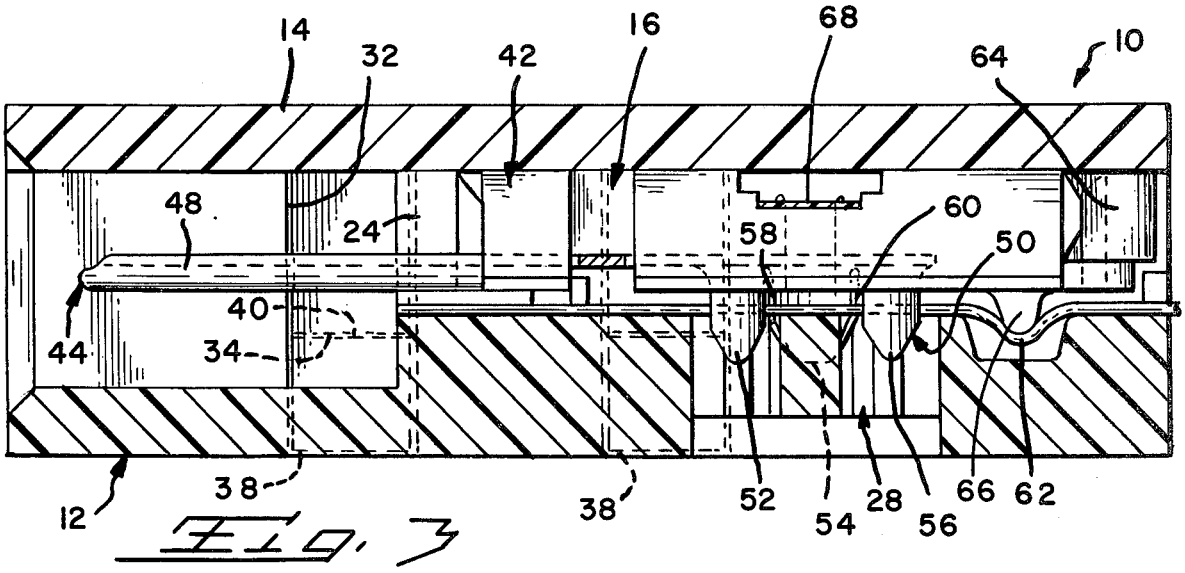
FIG. 3 is a transverse vertical section through the subject connector taken along line 3—3 of FIG. 1.

The wires 62 for multiple magnetic coils (not shown) of a dot matrix print head (also not shown) are laced into the appropriate channels 18 as shown in FIG. 4 (right side) and FIG. 2. The contact modules 42 are then individually or gang inserted, by hand or by machine, into the cavity in the base member. As each module is inserted, the tines 52, 54, 56 engage and terminate the respective conductors. Each insulation piercing portion 50 of the respective terminals 44 engages with the appropriate conductor 62 and is received into cavity 28 of the base 12. The profile of cavity 28 prevents spreading of the tines during or subsequent to termination thereby assuring tight contact. The modules 42 are held in the base by engagement of studs 64 in the wide entries 24 of the slots in rear wall 22. The stud 66 exerts a downward pressure on the conductors 62 to serve as a strain relief. When all of the conductors 62 have been appropriately terminated, the cover 14 is snapped into place with the lips 40 of latching legs 38 engaging in the shoulders 34 of passages 32. Thus the multiple wires can be effectively and rapidly terminated.

It is possible to repair or replace any of the magnetic coils of a dot matrix print head simply by removing cover 14, removing the appropriate modules 42, and withdrawing the conductors 62. The leads of a new or repaired magnetic coil are then threaded into the vacant channels 18 and the modules 42 and cover 14 replaced.

The present invention may be subject to many modifications and changes without departing from the spirit or essential characteristics thereof. The present embodiment is therefore intended in all respects to be illustrative and not restrictive of the scope of the invention.

What is claimed is:

1. A connector providing an interface between wires of a plurality of magnetic coils in a multi-dot matrix print head and conventional cables comprising:

a housing having a base member and a mating cover defining a cavity therebetween, said base member having a plurality of parallel spaced channels extending transversely across said cavity and defining a comb-like configuration in front and rear walls thereof, and means for latchingly securing said cover on said base; and a plurality of terminal modules, each said module including a terminal mounted in a rigid block of insulation material, each said terminal having a first mating portion profiled for mating with a further terminal and a conductor engaging second portion having a plurality of tines defining insulation displacing slots between adjacent pairs of tines, said modules being received in respective channels in said base member with the slots between the tines engaging conductors laid in said channels to form an electrical and mechanical engagement therewith.

2. The connector according to claim 1 further comprising:

a profiled slot in each said channel receiving said tines therein to restrict the lateral movement thereof during and subsequent to termination thereby assuring good electrical and mechanical engagement between each conductor and associated terminal.

3. The connector according to claim 1 further comprising:

means on said modules to secure them in said cavity against accidental removal, said means including at least one integral projection engaging in a respective comb-like configuration of said base member.

4. The connector according to claim 1 wherein said comb-like configurations each comprise:

a plurality of parallel spaced slots in said front and back walls of said base member aligned with the respective ends of said channels, each said slot having a stepped configuration defined by a broad module engaging entry portion and a narrow conductor engaging base portion.

5. The connector according to claim 4 wherein said mating portion of each said terminal extends through the broad entry portion of the respective slots.

* * * * *